United States Patent [19]

Ghislanzoni

[11] Patent Number: 4,974,351

[45] Date of Patent: Dec. 4, 1990

[54] HOOK FOR CLAMPING TOGETHER TWO PANELS FOR MAKING PICTURE HOLDERS OR SIMILAR OBJECTS

[75] Inventor: Antonio Ghislanzoni, Lecco, Italy

[73] Assignee: Pico-Glass S.P.A., Bologna, Italy

[21] Appl. No.: 915,270

[22] Filed: Oct. 3, 1986

[51] Int. Cl.[5] ..... G09F 1/12

[52] U.S. Cl. ..... 40/152; 40/156

[58] Field of Search ..... 63/152, 152.1, 156, 63/157

[56] References Cited

U.S. PATENT DOCUMENTS 3,186,117 6/1965 Detje ..... 40/156 X
4,217,710 8/1980 Becker ..... 40/156
4,235,030 11/1980 Astolfi ..... 40/152 X
4,509,278 4/1988 Astolfi ..... 40/156

FOREIGN PATENT DOCUMENTS 1536121 12/1978 United Kingdom ..... 40/156

*Primary Examiner*—Laurie K. Cranmer
*Attorney, Agent, or Firm*—Darby & Darby

[57] ABSTRACT

This device concerns a hook for clamping together two panels for making picture holders or similar objects, and to which a frame can be fitted. One of the basic features of the hook according to this invention is that a frame can be formed directly on the picture holder, one side at a time, obviating the need for the frame to be made beforehand.

9 Claims, 3 Drawing Sheets

FIG. 1
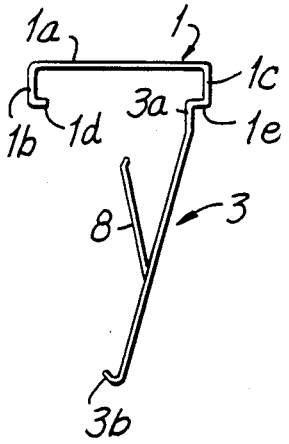
FIG. 2
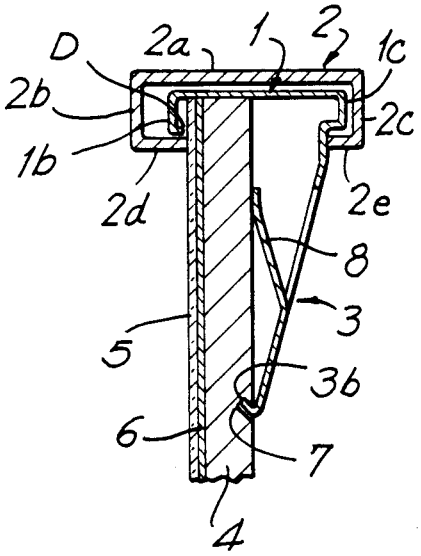
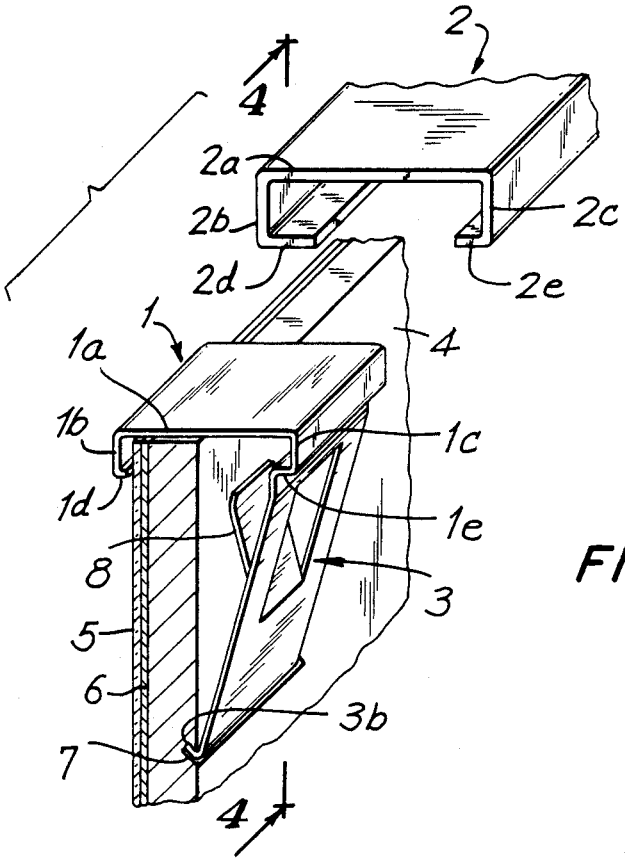
FIG. 3

HOOK FOR CLAMPING TOGETHER TWO PANELS FOR MAKING PICTURE HOLDERS OR SIMILAR OBJECTS

BACKGROUND OF THE INVENTION

1. Field of the Invention

This invention concerns a hook for clamping together two panels for making picture holders or similar objects, and to which a frame can be fitted.

Hooks of this type are well-known and clamp between them a first or back panel and a second, transparent or front panel, one against the other, between which the object to be displayed, generally a photograph, is inserted. These hooks are generally made of a thin, springy, suitably shaped metal plate, one side of which is fitted to the edges of the panels pressing them against each other, while one part of the other side of the hook is bent back and hooked into a slit or similar aperture on the back panel to complete the clamping action.

Picture holders made with these hooks have been widely marketed since they can easily be removed for disassembly of the panels and replacement of the photograph.

The picture holders in question nevertheless present a number of problems which have limited their use.

One problem is due to the fact that these picture holders have no lining or protection whatsoever on their edges, given that the panels are fixed together only by the hooks, whose width is extremely limited. This lack of covering on the edges of the picture holders exposes the object displayed between the panels to dust, humidity and vapors that induce rapid deterioration of the object. In this situation the chief function of the picture holder, i.e. to preserve the display object, is clearly lacking.

Another problem with the picture holders currently marketed derives from the fact that the securing hooks are visible and hence detract somewhat from the appeal of the holder.

In order to provide these picture holders with a frame, the practice has been to make the frame first and to then fit to it, with the hooks, the two panels, one front and back, inserting the display object between them. This solution has however been found to be very complicated because of preassembly of the frame which is generally carried out, in the case of wooden frames, by securing the ends of the frame at the corners, using for example glue or tacks, clamps, brackets or some similar device. This operation is rendered even more complex where metal or plastic frames are used.

Making the frames first noticeably increases production costs for the manufacturers of these picture holders.

OBJECTS AND SUMMARY OF THE INVENTION

It is an object of the present invention to provide a hook for clamping together two panels for making a picture holder or similar object which eliminates all the problems mentioned above.

One of the basic features of the hook according to this invention is that a frame can be formed directly on the picture holder, one side at a time, obviating the need for the frame to be made beforehand.

In this way all the long and complex preliminary operations mentioned above for assembling the frame are eliminated, and a clear and considerable reduction in production costs is also achieved.

Another advantage of the hook according to this invention, consequent upon the extreme ease with which the frame can be fitted and removed, consists in the fact that the picture holder can be sold with the frame completely detached which the purchaser can then fit himself. Indeed the detached frames could be sold separately from the panels of which the holder is composed, thereby increasing the consumers range of choice.

A further advantage of the hook according to this invention is that the frame can be made of materials other than wood which are at present infrequently used, such as plastics, aluminum, brass and other material which are difficult to assemble with the systems described above.

BRIEF DESCRIPTION OF THE DRAWINGS

The features and advantages of the hook according to this invention will be clear from the following detailed description provided by way of non-limiting example with reference to the attached figures, of which:

FIG. 1 is a side view of the hook according to this invention in its rest position before being fitted to the picture holder;

FIG. 2 is a cross section of the hook fitted to the picture holder on which a frame segment is applied;

FIG. 3 is a perspective view of the hook fitted to the holder with a frame segment detached from the hook;

DETAILED DESCRIPTION OF THE PREFERRED EMBODIMENTS

Figure 4:
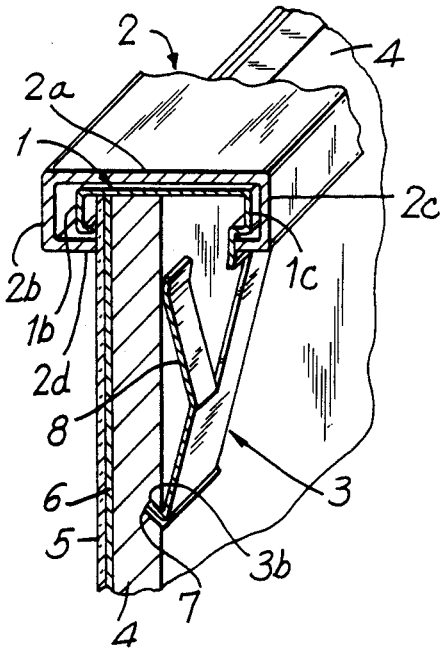
FIG. 4 is a perspective view of the hook applied to the picture holder and onto which the frame segment is fitted according to section 4—4 of FIG. 3.

Before describing in detail the hook according to this invention, it should be noted that the hook is shown in the attached figures fitted to a part of one of the sides of the picture holder. This part could clearly be either a section half-way along the side of the picture holder or an end section of the same, according to the size of the picture holder. In fact the hook in question may be fitted on its own or together with another hook on each side of the picture holder; clearly the number and position of the hooks does not have any bearing on the innovative concept of the invention.

Reference will be made first to FIGS. 1 to 5.

In these figures, and in particular in FIG. 1, it will be noted that the hook as per this invention is basically L-shaped in cross section, one side of which, indicated by the reference number 1, may be considered the "head" of the hook which will be fitted to the edges of the panels while its top side will receive and hold in place the section, indicated by the reference number 2, representing one side of the frame. The other side of the hook, designated by reference number 3, is the part that will be placed behind the back panel of the picture holder and hooked to this to make fast the hook and thus hold the two panels together.

The picture holder is normally composed of a back panel 4 made of opaque material such as card, plastic, wood or the like, and a front, transparent panel 5 made for example of plastic, glass or similar material. The display object 6, generally a photograph, is inserted between the back panel 4 and the front panel 5.

The part 1 or "head" of the hook to be fitted to one of the edges of the picture holder and on the top of which section 2, representing a segment or side of the frame, is to be fitted, presents a basically C-shaped cross section, as shown in particular in FIGS. 1 and 2; the main side 1*a* of this will be positioned perpendicularly to elements 4, 5 and 6, representing the picture holder, while the extreme edges 1*d* and 1*e* of its two opposite sides 1*b* and 1*c* are bent inwardly at 90° to these two sides. Both sides 1*b* and 1*c*, as shown, are basically straight and set at 90° to side 1*a*. It is nevertheless possible that one of these sides, especially the rear side 1*c*, has a curved profile in the form of an outwardly convex arc for example.

The second side 3 of the hook is basically flat and straight and, in its rest position (FIG. 1), it forms an angle of less than 90° with the surface in which the head 1 lies. The end edge 3*a* of side 3 of the head 1 of the hook is bent at an obtuse angle to side 3 and forms a 90° angle with edge 1*e* of the head 1.

The other end edge 3*b* of side 3 of the hook is bent inwardly so that, when the hook is fitted to the picture holder, this edge 3*b* clicks elastically into place in the slot 7 in the back panel 4, thus securing the hook to the holder.

Lastly, the hook in question has, on side 3, a tongue 8 cut into it and bent inwards so that, when the hook is fitted to the picture holder, the tongue exerts a certain pressure on the back panel 4 to ensure that the hook and frame are firmly secured, as will be made clearer below.

The particular shape of the head 1 of the hook, as described above, permits the application of a section 2 representing one of the sides of the frame. In particular this section 2, like the head 1 of the hook, is basically C-shaped in cross section. The main side 2*a* of the section 2 is positioned parallel to and in contact with the main side 1*a* of the head 1 of the hook, while end edges 2*d* and 2*e* of its opposite sides 2*b* and 2*c* are bent at 90° to the latter so that the section 2 can encompass the head 1 of the hook.

Figure 5:
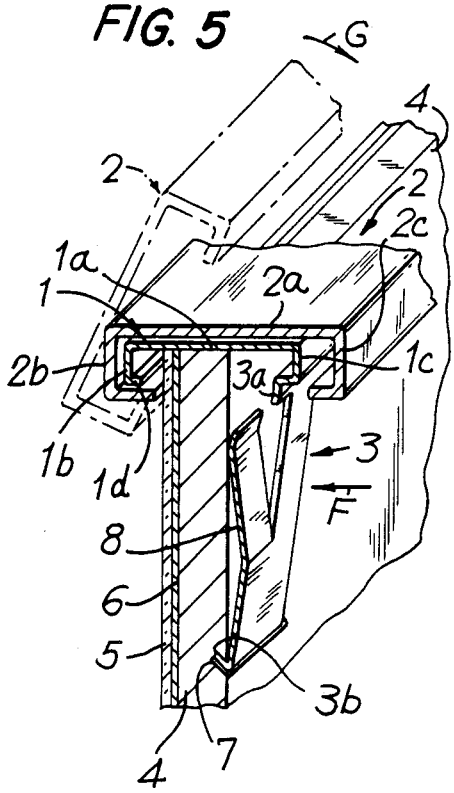
FIG. 5 presents a similar view to that of FIG. 4 showing how the frame segment is applied to the hook.

Reference is made to FIGS. 1 to 5 and in particular to FIG. 5 in the following description of assembling one side of the frame.

First of all the hook is fitted to the picture holder so that it is arranged as shown in FIG. 3. In particular, when the hook is applied, its two sides, i.e. the head 1 and the side 3, are forced away from each other to allow the bent edge 3*b* of the side 3 to be inserted in the slot 7 in the back panel 4. The hook, whose elasticity exerts pressure to bring it back to its rest position as shown in FIG. 1, besides securing the bent edge 3*b* in the slot 7, also forces the bent edge 1*d* of the head 1 of the hook against the front panel 5. This securing action is increased by the tongue 8 which, exerting pressure on the rear panel 4, pulls the hook towards the back of the picture holder, thereby increasing the pressure exerted by the bent edge 1*d* on the front panel 5.

At this point the section 2 can be fitted to the head 1 of the hook and for this purpose, as shown in FIG. 5, pressure is first of all applied to the hook in the direction of the arrow F so that, compressing the tongue 8, the side 3 of the hook is brought towards the back panel 4, while at the same time the bent edge 1*d* of the head 1 of the hook moves free of the front panel 5. The section 2 is positioned with its bent edge 2*d* against the front panel 5 and, when the hook has been brought to the position shown in FIG. 5, the section 2 is rotated in the direction of the arrow G until it is taken from the position represented with the broken line to the one shown by the continuous line. The hook is then released and the pressure removed from its rear side 3 so that it returns to the state shown in FIGS. 2 and 4. It will be noted from these figures that the bent edges 2*d* and 2*e* of the section 2 exert pressure on the front panel 5 of the picture holder and on the section 3*a* of the rear side 3 of the hook respectively. At this stage the side of the frame in question completely encompasses the head 1 of the hook and is held in position thanks to the action of its bent edges as described above. The position of the frame section 2 and its clamping on the head 1 of the hook are particularly stable thanks also to the fact that the bent edges 1*d* and 1*e* of the head 1 of the hook prevent any upward movement by the frame since these bent edges constitute a buffer for the bent edges 2*d* and 2*e* of the section 2.

The frame is completed by proceeding as explained above on the remaining three sides of the picture holder.

To remove the section, i.e. to remove the frame itself, the same operation a described above is carried out in reverse; for this reason removal of the frame is not described in detail here.

Referring in particular to FIG. 2 it is noted that when the section 2 is applied to the head 1 of the hook, the bent edge 1*d* of the latter is no longer in contact with the front panel 5; in fact, a certain gap D is created between the two components. This feature has been included to ensure that the pressure exerted by the tongue 8 is transmitted from the edge 3*a* of the hook to the section 2 with the result that its edge 2*d* fits perfectly to the front panel 5. Without this gap the frame could remain slightly detached from the panel 5 which would detract from the final visual effect of the picture holder.

Figure 6:
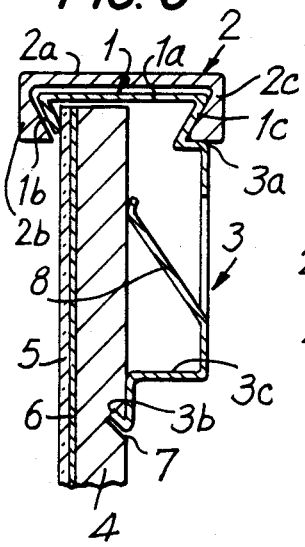
FIG. 6 is a cross section view of a hook similar to that in FIG. 1 applied to the picture holder.

FIG. 6 shows a cross section of a hook very similar to the one shown in FIGS. 1 to 5, which embodies the same innovative concept as the preceding type. In this figure the parts similar to those in FIGS. 1 to 5 are indicated with the same reference numbers. It will be noted that in this case too the head 1 of the hook is basically C-shaped while its opposite sides 1*b* and 1*c* are angled towards each other. The shape of the inside of frame section 2 is complementary, in cross section, to the outside of the head 1 of the hook so that the frame can be slid lengthways onto the head. The section 2 is therefore C-shaped and its two opposite sides 2*b* and 2*c* gradually thicken in the direction of convergence of sides 1*b* and 1*c* of the head 1 of the hook.

Furthermore, it will be noted that the top end edge 3*a* of the rear side 3 of the hook forms an acute angle with the side 1*c* of the head 1 of the hook, thereby creating a seat for side 2*c* of the section 2. Lastly, the rear side 3 of the hook is connected to the bottom end edge 3*b* by means of a basically L-shaped piece, one side of which is in contact with the rear panel 4.

Figure 7:
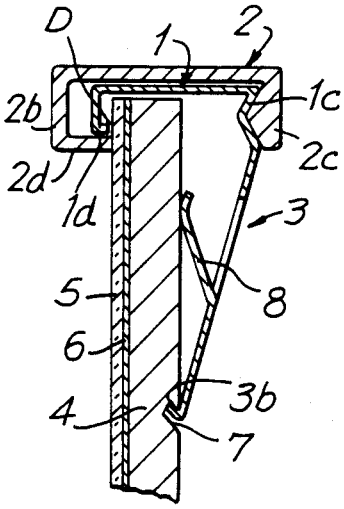
FIG. 7 is a cross section view of a hook similar to that in FIG. 1 applied to the picture holder.

The hook shown in cross section applied to the picture holder in FIG. 7 also employs the same innovative concept as the hooks described in FIGS. 1 to 6, since in this case too the head 1 is essentially C-shaped. In this figure too the components similar to those in the preceding figures are indicated with the same reference numbers. In more detail, one of the two opposite sides of the C, the front side 1*b* of the head 1, has its end edge 1*d* bent at 90° and with gap D to the glass 5. The bent edge 2*d* of the section 2 engages with the front panel 5 for the reasons set out above relating to FIG. 2. The second of the two opposite sides of the head 1, the rear side 1*c*, has a basically central and longitudinal depression to give the side a more or less V-shape. This therefore provides a seat for the side 2*c* of the section 2 which accordingly has a central, longitudinal projection of a shape complementary to the shape of side 1*c*. It should be noted that in this case too the section 2 is basically C-shaped in cross section.

The application and removal of the section 2 from the hook shown in FIG. 7 are carried out in the same way as for the hook in FIGS. 1 to 5. In this case too the length of the bent edge 2*d* of the section 2 is greater than the length of the bent edge 1*d* of the head 1 of the hook.

Figure 8:
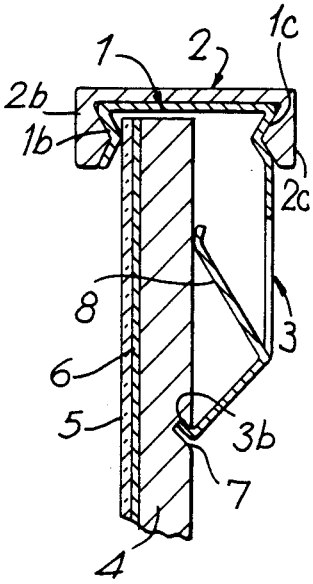
FIG. 8 is a cross section view of a hook similar to that in FIG. 1 applied to the picture holder.

The hook according to this invention illustrated in FIG. 8 is also equipped with a C-shaped head when viewed in cross section. Its two opposite sides have projecting parts corresponding to depressions to allow application of the section 2 of the frame, the inside of which has a complementary shape in cross section to that of the head 1 so that when the section 2 is fitted to the head 1 it completely encompasses the latter and cannot be removed.

As may be noted in the above-mentioned figure, the opposite sides 1*b* and 1*c* of the head 1 each have a central, longitudinal depression giving them a basically V-shape. Correspondingly, the opposite sides 2*b* and 2*c* of the section 2 have a central, longitudinal projection with a shape complementary to the V of the sides 1*b* and 1*c* of the hook. These projections, once inserted in the depressions of sides 1*b* and 1*c*, secure the section 2 to the picture holder. In this case, as with the hook in FIG. 6, section 2 is fitted to the head 1 of the hook by sliding the section 2 along the head 1; application from the side as shown in FIG. 5 for the hook illustrated in FIGS. 1 to 5 cannot be carried out in this case.

Application from the side as described above is particularly useful since it is clear that with this method a complete frame can be fitted, which would not be possible using the hooks described in FIGS. 6 and 8. Indeed the method which entails sliding the frame sections 2 onto the head 1 of the hooks can be carried out only on three sides. The fourth section must necessarily be applied from the side as illustrated in FIG. 5. Therefore a complete frame may be composed in two ways: either by using the hooks described in FIGS. 1 to 5 or 7 on all four sides, or else by using one of the hooks illustrated in FIGS. 6 and 8 on three sides and one of the hooks illustrated in FIGS. 1 to 5 and 7 on the fourth side.

Figure 9:
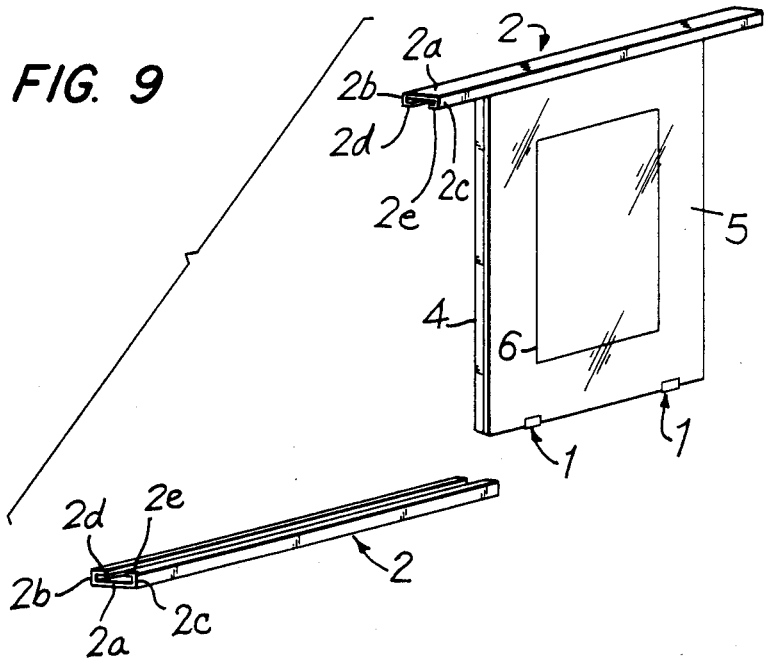
FIG. 9 is a perspective view showing a frame fitted on the hook according to this invention.
Figure 10:
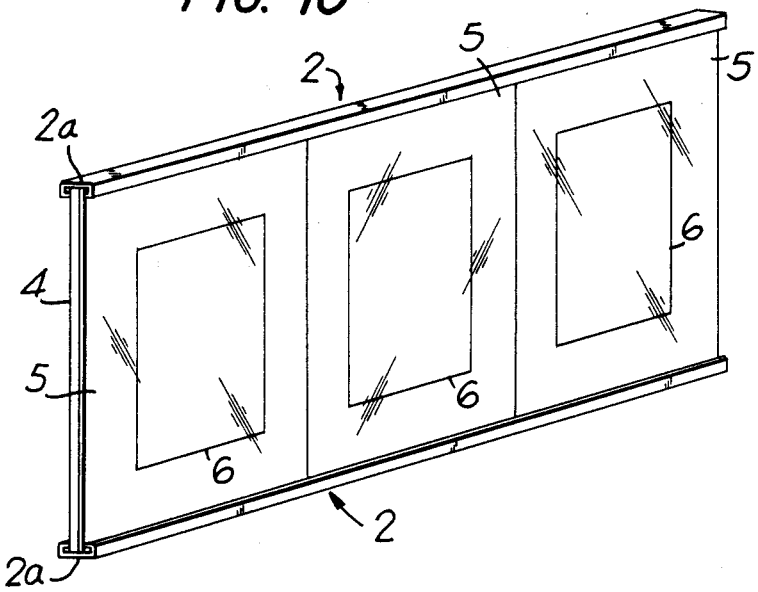
FIG. 10 is a perspective view showing another example of a frame that can be created using the hook according to this invention.

FIGS. 9 and 10 show two of the many frame combinations possible with the hook according to this invention. The frames shown in FIGS. 9 and 10 envisage the application of section 2 on only two opposite sides of the picture holder, the top and bottom edges. This application should however be regarded as merely an example since, as described above, the frame may be fitted to all four sides of the picture holder. With particular reference to FIG. 9 in which the parts similar to those of the preceding figures are indicated with the same reference numbers, two sections 2 are fitted to the top and bottom edge respectively with the application of two hooks as per this invention on each of the two sides, the heads 1 of which are indicated clearly on the bottom edge.

It will also be noted that the length of the section 2 is greater than the corresponding edge of the picture holder on which the frame is fitted. This may be regarded as an original and effective way of framing the holder, but naturally the length of the sections 2 may be equal to that of the sides of the picture holder and be completed on the remaining vertical sides.

The picture holder shown in FIG. 10 is a multiple frame in which three subjects or six photographs can be displayed, each of which is inserted between a back panel 4 and a front panel 5. The length of the sections 2 is equal to the sum of the top and bottom sides of the panels. On each of these panels, though not visible in FIG. 10, one or two hooks are fitted, as shown diagrammatically in FIG. 9.

The picture holder in FIG. 10 can also be completed with two other sections 2 on the vertical sides.

Finally, it is clear that variations and/or alterations can be made to the hook as per this invention, without going beyond the range of protection provided for the invention itself.

What is claimed is:

1. A combination of a frame side and a hook for clamping together a front panel and a rear panel to make a framed picture holder having at least one straight edge, when clamped said front panel having a front face and said rear panel having a rear face, said hook comprising:

a generally L-shaped plate of resilient material having two sides connected with an angle between them, one side or head having ends and said head being dimensioned for extending entirely across said straight edge in the thickness direction of said clamped panels and said head having a first extension at one said end extending transversely to said thickness direction to oppose a portion of said front face when said hook is mounted to said picture holder, said second side of said hook being for opposing said rear panel face, said second side including first engagement means for releasably engaging said rear panel and pressure means for resiliently pressing against said rear panel face when said hook is mounted to said picture holder, said hook when releasably engaged with and pressing said rear panel and opposing said front face, absent deformation, being constrained against movement in said thickness direction by said first engagement means and said first extension, and a frame side, said frame side being of extended length and having a generally C-shaped cross section, said C-shape including an intermediate segment and two generally transverse end segments, said frame side and said one hook side being dimensioned to nest said hook head within said C-shape of said frame side, said frame side and said hook head including second engagement means for inter-engaging said hook head and said frame side within said C-shape, said inter-engagement preventing separation of said frame side from said hook by motion transverse to said edge and to said thickness direction when said hook is mounted to said picture holder.

2. A combination as in claim 1, wherein said head includes a second extension at its other end extending transversely to oppose at least a portion of said rear panel face.

3. A combination as in claim 2, wherein said second end extension of said head is curved in cross section.

4. A combination as in claim 2, wherein said head extensions extend toward each other, and said inter-engagement between said frame side and said hook is dove-tailed.

5. A combination as in claim 2, wherein said head extensions are V-shaped in cross section, the apices of said V-shapes facing each other.

6. A combination as in claim 2, wherein said head extensions include a bend toward each other.

7. A combination as in claim 1, wherein said hook angle is 90°.

8. A combination as in claim 1, wherein said second engagement permits sliding between said hook and said frame side in the direction of said frame side length.

9. A combination as in claim 1, wherein said first engagement means is a hook for engaging a slot in said back panel.

* * * * *